United States Patent [19]

Nakatani

[11] 4,210,044

[45] Jul. 1, 1980

[54] ROLL PAPER CUTTING ARRANGEMENT

[75] Inventor: Keiji Nakatani, Machida, Japan

[73] Assignee: Minolta Camera Kabushiki Kaisha, Osaka, Japan

[21] Appl. No.: 5,013

[22] Filed: Jan. 19, 1979

[30] Foreign Application Priority Data

Feb. 3, 1978 [JP] Japan ..... 53-11827

[51] Int. Cl.[2] ..... B26D 5/26

[52] U.S. Cl. ..... 83/241; 83/205; 83/208; 83/366

[58] Field of Search ..... 83/208, 205, 241, 369, 83/366

[56] References Cited

U.S. PATENT DOCUMENTS 3,779,114 12/1973 Rabin ..... 83/205

3,817,134 6/1974 Katayama et al. ..... 83/203

*Primary Examiner*—Frank T. Yost

*Attorney, Agent, or Firm*—Wenderoth, Lind & Ponack

[57] ABSTRACT

The disclosure relates to a roll paper cutting arrangement for use in mechanical equipment employing a roll of paper to be cut into predetermined length for use, and including cutter which is caused to function by switching members sequentially actuated in a predetermined relation with the feeding amount of the paper drawn from the roll at a predetermined transportation speed, with the cut length of the paper being made variable through selective use of the switching members. The cutting arrangement is provided with memory component to be actuated by the functioning of the selected switching members for maintaining predetermined memory state, and signal producing component for generating cutter actuation signal following the functioning of the memory component.

8 Claims, 10 Drawing Figures

ROLL PAPER CUTTING ARRANGEMENT

BACKGROUND OF THE INVENTION

The present invention relates to a paper cutting arrangement and more particularly, to a roll paper cutting arrangement for use in mechanical equipment such as copying apparatuses, printing presses, etc., which includes cutter means operated by a plurality of switching means sequentially actuated by a predetermined relation with respect to the feeding amount of paper fed from a roll of paper at a predetermined speed.

In mechanical equipment, for example, copying apparatuses, printing presses and the like in which printing or copying paper stocked in a roll form is employed to be drawn out for use according to necessity, arrangements for cutting the paper drawn out from the roll to a predetermined length are required.

There have conventionally been proposed various types of roll paper cutting arrangements of the above described kind, in one of which cam means is employed for rotation in synchronization with the functioning of the mechanical equipment so as to turn ON switching means such as microswitches, etc. for actuating the cutter means.

In the arrangement as described above, if a plurality of sets of combinations of the cam means and switching means are provided, with timing for actuating the switch means being deviated for each cam means, the printing paper fed from the roll may be cut into a plurality of predetermined lengths.

In FIG. 1, there is shown a cutter actuation means of the above described type, while FIG. 2 shows one example of conventional circuit constructions to be coupled with the cutter actuation means of FIG. 1. Meanwhile, in FIGS. 3 and 4, there is shown one example of the mechanical equipment in the form of a microfilm reading and printing apparatus or microfilm reader and printer M which employs the printing paper P in the roll form and to which the present invention may be applied.

In FIGS. 1 to 4, although functioning of the microfilm reader and printer itself of FIGS. 3 and 4 will be described in detail later, general function thereof is such that, upon starting of the transportation of the printing paper P through driving of a pair of driving rollers $d_1$ holding the leading edge of the printing paper P therebetween by a print instruction signal, a cam shaft 1 is rotated by a worm Wa and a wheel Wb to be driven in synchronization therewith by transmission mechanism including a chain 4, etc. On the cam shaft 1, there are fixedly mounted, for example, a group 3 of sequence control cams for the microfilm reader and printer M and another group 2 of cutter actuation control cams for rotation simultaneously with the rotation of the cam shaft 1. The cam shaft 1 together with the cam groups 2 and 3 are arranged to complete one rotation for each copying operation of the microfilm reader and printer M in synchronization with driving of other transportation rollers, etc., through clutch mechanism and the like (not shown). Meanwhile, microswitches MS are disposed in positions corresponding to the respective cams to be actuated following rotation of such cams.

Hereinbelow, the actuation control of the cutter means will be briefly described with reference to FIGS. 1 and 2.

The cutter actuation control cam group 2 mounted on the cam shaft 1 includes n pieces of cams $C_1$, $C_2$, $C_3$, . . . and $C_n$, with the same number of the microswitches $MS_1$, $MS_2$, $MS_3$, . . . and $MS_n$ being provided to correspond to said cams $C_1$ to $C_n$. The cams $C_1$ to $C_n$ are respectively provided with notches $N_1$, $N_2$, $N_3$, . . . and $N_n$ which are arranged to be sequentially deviated in their positions with respect to the cam shaft 1, while the microswitches $MS_1$ to $MS_n$ are adapted to close the circuit upon engagement of their actuators with said notches. As shown in FIG. 2, each of the contacts of the microswitches $MS_1$ to $MS_n$ is connected to a solenoid 5*s* of the cutter means 5 including a stationary blade 5*a* and rotary blade 5*b* through a rotary switch $SW_1$ functioning as a selecting switch.

On the assumption that the rotary switch $SW_1$ selects the microswitch $MS_1$ for the shortest cut length of the printing paper P, with the movable contact tc of the rotary switch $SW_1$ connected to the contact $P_1$ of the stationary contacts $P_1$ to $P_n$ leading to the microswitch $MS_1$, feeding of the printing paper P is started as described earlier, with simultaneous rotation of the cam shaft 1, and the microswitch $MS_1$ is closed by the engagement of the actuator thereof with the notch $N_1$ of the cam $C_1$ to supply voltage from a power source E to the cutter solenoid 5*a* through a resistor R for actuation of the cutter means 5. The other microswitches $MS_2$ to $MS_n$ are also actuated in the similar manner to the above, and the cut lengths of the printing paper are determined by the timing by which the notch of the cam corresponding to the selected microswitch causes the actuator of the particular microswitch to function. The timing as described above may be readily set from the relation between the feeding speed for the printing paper P and rotational speed of the cam shaft 1, etc.

Although the known cutter actuation control mechanism as described above is capable of selecting a plurality of cut length through very simple construction, it has disadvantages as described hereinbelow.

More specifically, in FIGS. 1 and 2, for example, when the microswitch $MS_1$ is first selected with the movable contact of the rotary switch $SW_1$ connected to the stationary contact $P_1$ for the microswitch $MS_1$, the cam shaft 1 continues to rotate even after the cutter solenoid 5*a* is energized by the closing of the microswitch $MS_1$, and thus other microswitches $MS_2$ to $MS_n$ are sequentially brought into the closed state. Therefore, if either one of the microswitches $MS_2$ to $MS_n$ is selected through rotation of the rotary switch $SW_1$ after the microswitch $MS_1$ has been closed, the cutter means 5 is undesirably actuated again. Moreover, since there exists a certain extent of time interval while the microswitches $MS_1$ to $MS_n$ are actuated by the cams $C_1$ to $C_n$, if the rotary switch $SW_1$ is further moved or changed over during such time interval, there may be a case where the cam shaft 1 completes one rotation before the cutter solenoid 5*s* is not energized at all.

As described in the foregoing, actuation of the cutter means 5 more than two times in one cycle results in the printing paper cut to shorter lengths, thus giving rise to paper jamming and the like, while non-functioning of the cutter means 5 is extremely disadvantageous, for example, when control of other sequences are being effected through the actuation of the cutter means, with further problems related to wasteful consumption of the printing paper P.

SUMMARY OF THE INVENTION

Accordingly, an essential object of the present invention is to provide a roll paper cutting arrangement for use in mechanical equipment such as copying apparatuses, printing presses and the like in which cutter means for cutting the paper fed from the roll of paper is actuated one time per one operation cycle of the mechanical equipment without fail, while it is positively prevented form being actuated more than two times during such one operation cycle of the mechanical equipment.

Another important object of the present invention is to provide a roll paper cutting arrangement of the above described type in which such inconvenience in the conventional arrangements that the cutter means does not function at all due to wrong operation of means for selecting a particular switching means is positively prevented.

A further object of the present invention is to provide a roll paper cutting arrangement of the above described type which is simple in construction and accurate in functioning, and can be readily incorporated into various mechanical equipment at low cost.

In accomplishing these and other objects, according to one preferred embodiment of the present invention, there is provided a roll paper cutting arrangement for use in mechanical equipment employing a roll of paper to be cut into predetermined length which includes means for transporting the paper which draws out a leading end of the paper from the roll for transportation, means for cutting the paper to the predetermined length on the passage of transportation of the paper, power source for actuating said cutting means, a first switching means for connecting said power source with said cutting means, a plurality of second switching means, means for sequentially actuating said plurality of second switching means in association with functioning of said transporting means at predetermined relation with respect to feeding amount of the paper, means for selecting one of said plurality of second switching means, and means for memorizing the function of the selected one of said plurality of second switching means. The memorizing means is connected to said second switching means through said selecting means, while the first switching means is so arranged as to be actuated following the memorizing function of said memorizing means. By the above arrangement, not only the inconveniences inherent in the conventional arrangements that the cutter means is actuated more than two times in one cycle of operation of the mechanical equipment have been positively eliminated, but also the disadvantage in the known arrangements that the cutter means does not function at all during one operating cycle of the mechanical equipment due to wrong operation of the switch selecting means can be positively prevented.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
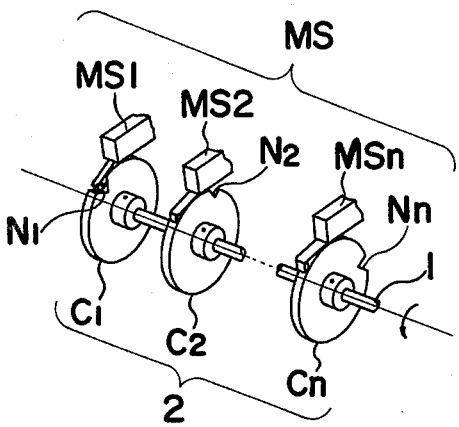
FIG. 1 is a fragmentary perspective view showing, on an enlarged scale, an arrangement of a cutter actuating cam group and a corresponding switch group to which the present invention may be applied.
Figure 2:
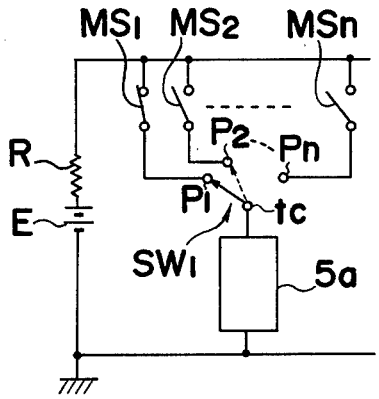
Fig. 2 PRIOR ART
FIG. 2 is an electrical circuit diagram showing a conventional circuit construction (already referred to) to be associated with the arrangement of FIG. 1.
Figure 3:
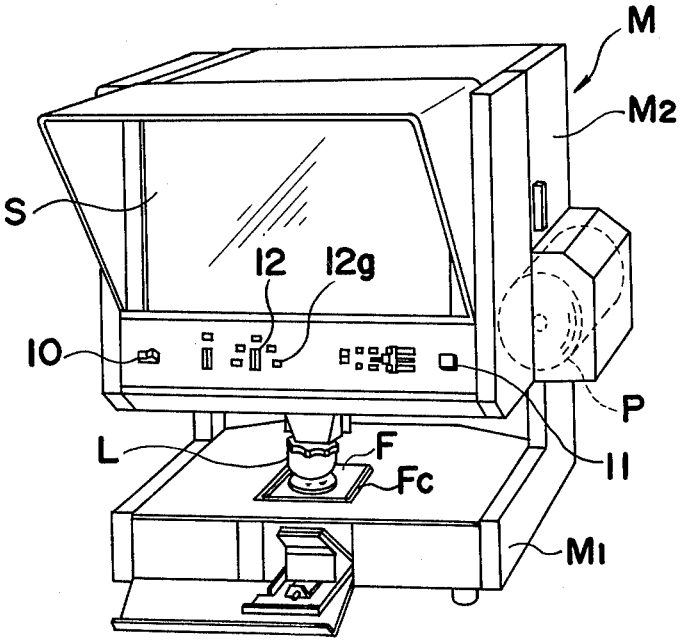
FIG. 3 is a perspective view of a microfilm reading and printing apparatus to which the roll paper cutting arrangement according to the present invention may be applied.
Figure 4:
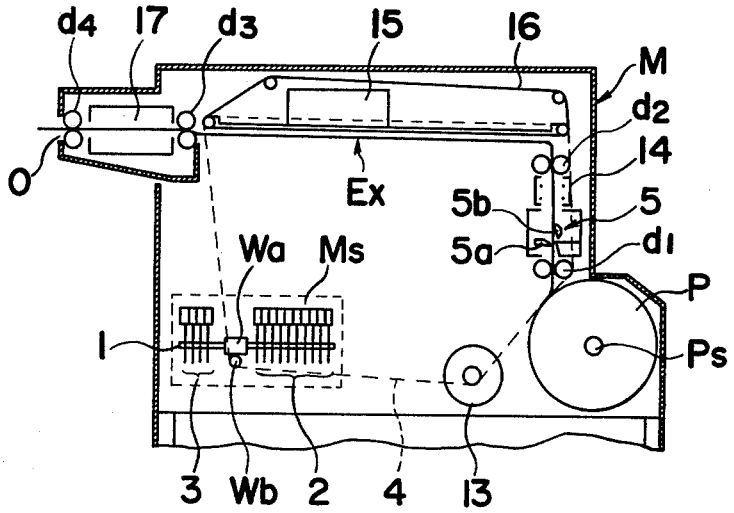
FIG. 4 is a schematic side sectional view showing a main portion of the microfilm reading and printing apparatus of FIG. 3, FIG. 5(*a*) is an electrical circuit diagram showing a circuit construction according to the present invention to be associated with the arrangement of FIG. 1, FIG. 5(*b*) is a time chart explanatory of the sequence of operation of the circuit of FIG. 5(*a*)
Figure 5:
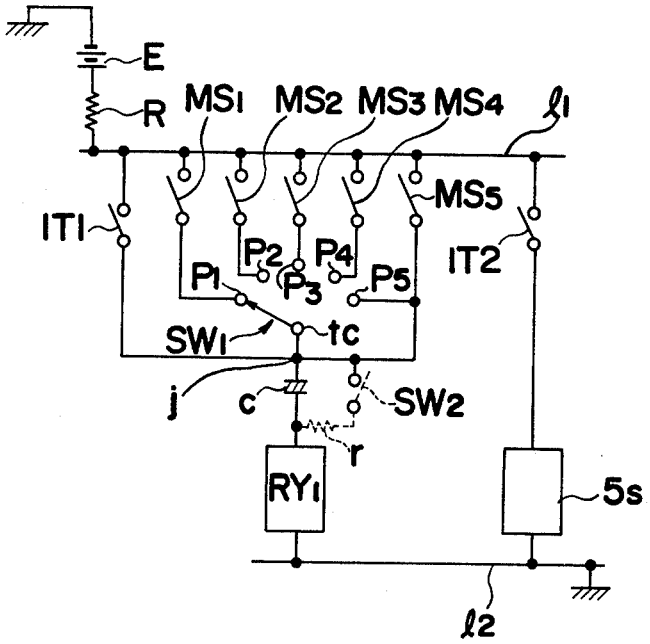
Figure 5:
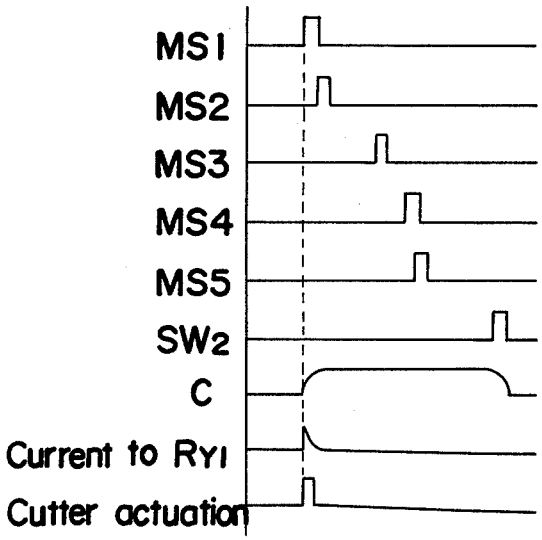

Referring now to the drawings, there is shown in FIGS. 3 and 4 the microfilm reading and printing apparatus or microfilm reader and printer M to which the present invention may be applied. The microfilm reader and printer M is provided with the cam group 2 and microswitches $MS_1$, $MS_2$, . . . and $MS_n$ associated therewith as earlier described with reference to FIG. 1 which are coupled to an electrical circuit according to the present invention as shown in FIG. 5(*a*), and generally includes a base portion $M_1$ and a main body $M_2$ extending upwardly from the base portion $M_1$ and having at its front wall an observation screen or display surface S. On the base portion $M_1$, there is disposed a carrier Fc mainly of light transmitting material, for example, of glass on which information bearing media such as microfilms F are held flat to be illuminated through a condenser lens assembly (not shown) by a light source (not shown) disposed within the base portion $M_1$ immediately below and adjacent to the carrier Fc so that light images of information or data contained in the microfilm F are projected onto the observing screen S by a projecting lens assembly L through reflection mirrors, etc. (not shown) contained in the main body $M_2$ and arranged to be displaced during copying operation for directing the light images to an exposure station Ex.

At the lower right side of the main body $M_2$, there is rotatably provided a spool Ps on which photosensitive copy paper P is stored in a roll form with its leading edge held between feeding rollers $d_1$, while along a passage of the copy paper sheet P, the cutter means 5, corona charger 14, another pair of transportation rollers $d_2$, and a suction belt 16 movably supported by a plurality of rollers and, associated with a suction unit 15 are sequentially disposed. The copy paper P is subjected to exposure to image-wise light, as it is fed through the above described passage, at the exposure station Ex whereat portion of the suction belt 16 is kept flat through attraction by the suction unit 15. Along the passage from the exposure station Ex to a discharge outlet O for the copy paper P, there are sequentially disposed a pair of transportation rollers $d_3$, and a developing and drying device 17 including, for example, a pair of absorbing rollers $d_4$. On the other hand, on the front wall of the main body $M_2$ at its lower portion adjacent to the observing screen S, there are disposed, for example, a power switch 10, a printing switch 11, a knob 12 of the change-over or rotary switch $SW_1$ for copying size selection provided with copy size indication marks 12g, etc.

In the above arrangement, upon depression of the print switch 11, rotation of a driving motor 13 provided at the lower right portion of the main body $M_2$ in FIG. 4 is transmitted to the rollers $d_1$ and $d_2$, the rollers for driving the suction belt 16 and the transmission mechanism including the worm Wa and gear Wb through the chain 4, and thus, the feeding of the copy paper P is started, while the cam shaft 1 starts rotating in synchronization with the rotation of the copy paper feeding rollers $d_1$ for consequent rotation of the cutter actuation control cam group 2 and sequence control cam group 3.

The copy paper P drawn out from the roll is uniformly charged on its photosensitive surface by the charger 14 for being fed to the exposure station Ex, and when the paper P has been transported by a suitable length, it is cut to a predetermined length by the actuation of the cutter means 5 including the stationary blade 5a and rotary blade 5b through a signal supplied by a cutter actuation control circuit mentioned in detail later so as to be exposed to the lightwise image of the microfilm at a stationary state in the exposure station Ex provided with the transportation belt 16 having the suction unit 15. Subsequently, the paper P is discharged out of the reader and printer M through the developing and drying device 17 and the discharge opening O. Controls for turning on and off of the corona charger 14, stopping and driving of the transportation belt 16, and turning on and off of the light source or exposure lamp (not shown) are effected by the functioning of the sequence control cam group 3 and copy paper detecting switches (not shown) provided in the passage for the copy paper P through suitable control means (not shown).

In the roll paper cutting arrangement directly related to the present invention, the microswitches $MS_1$, $MS_2$, ... and $MS_n$ sequentially actuated by the corresponding cams $C_1$, $C_2$, ... and $C_n$ are disposed in the control circuit shown in FIG. 5(a), in which the numbers n of the microswitches and cams are set to be five by way of example.

More specifically, in the circuit of FIG. 5(a), terminals at one side of the microswitches $MS_1$, $MS_2$, $MS_3$, $MS_4$ and $MS_5$ are connected to a power line $l_1$ leading to a power source E through a resistor R, while terminals at the other side thereof are respectively connected to corresponding stationary or selection contacts $P_1$, $P_2$, $P_3$, $P_4$ and $P_5$ of the rotary switch $SW_1$. The movable contactor or common terminal tc of the rotary switch $SW_1$ is coupled to one side of a capacitor C at a junction j which is further connected to the power line $l_1$ through a normally open contact $1T_1$ of a relay $RY_1$ and also to the power line $l_1$ through the microswitch $MS_5$. The other side of the capacitor C is coupled to a ground line $l_2$ through the relay $RY_1$, with a junction between the capacitor C and the relay $RY_1$ being connected to the line leading from the junction j to the microswitch $MS_5$ through a resistor r and a switch $SW_2$, while the cutter solenoid 5s of the cutter means 5 is coupled at its one side, to the power line $l_1$ through another normally open contact $1T_2$ of the relay $RY_1$, and also to the ground line $l_2$ at its other side.

Figure 6:
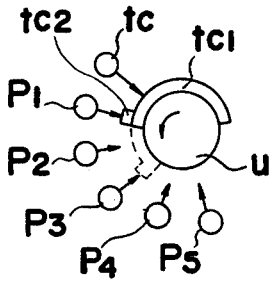
FIG. 6 is a schematic diagram showing a specific structures of a rotary switch for selecting particular switches which may be applied to the circuit of FIG. 5(*a*)
Figure 7:
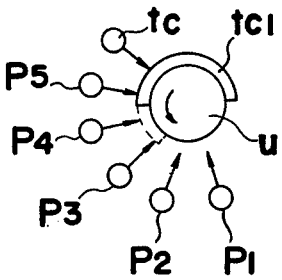
FIG. 7 is a similar view to FIG. 6, but particularly shows a modification thereof.

It is to be noted here that in the rotary switch $SW_1$ to be rotated following rotation of the change-over knob 12 for the size selection as described earlier, the copy size indication marks 12g respectively correspond to the selection terminals $P_1$ to $P_5$ which are arranged in a manner as shown in FIG. 6 or FIG. 7. In the arrangement of FIG. 6, a contact piece $tc_1$ for the common terminal tc secured to a rotary shaft u of the rotary switch $SW_1$ is connected, at its contact $tc_2$, only to the selected one of the stationary contacts $P_1$ to $P_5$, while in FIG. 7, the contact piece $tc_1$ of the common terminal tc sequentially shortcircuits the contacts $P_1$ to $P_5$ at the side thereof representing a longer cut length, starting for example, from the contact $P_5$ toward the contact $P_1$ as the shaft u is rotated in the direction of the arrow.

By the above arrangement, on the assumption that the rotary switch $SW_1$ is connected to the contact $P_1$, the microswitches $MS_1$ to $MS_5$ are sequentially closed following the rotation of the cam shaft 1 and cam group 2, and when the microswitch $MS_1$ is closed, current supplied from the power source E is charged into the capacitor C through the resistor R and rotary switch $SW_1$. During the above time, the current also flows through the relay $RY_1$ for actuation thereof to close its contacts $1T_1$ and $1T_2$, with simultaneous actuation of the cutter means 5 and self-retaining of the relay $RY_1$, and thus, the cutter means 5 is continuously energized until the capacitor C has been fully charged and current flowing through the relay $RY_1$ is interrupted. Upon completion of the charging of the capacitor C, the relay $RY_1$ is de-energized, with the contacts $1T_1$ and $1T_2$ thereof opened and the cutter means 5 also turned OFF.

Although the microswitches $MS_2$ to $MS_5$ are sequentially closed thereafter, the relay $RY_1$ is not energized since the capacitor C is charged, even if the rotary switch $SW_1$ is operated for connection to the contact $P_2$, $P_3$ or $P_4$, and therefore, the relay $RY_1$ and cutter means 5 are not actuated as is seen from a time chart of FIG. 5(b).

In the circuit construction as described above, the capacitor C acts as a kind of memory means, and once charged to be in the memorizing state, functions to prevent the cutter means 5 from being actuated by the operation of other switches, and the relay $RY_1$ is actuated only when the capacitor C as the memory means is being charged to close the contact $1T_2$ of the relay $RY_1$ for providing the cutter actuation signal. Meanwhile, the microswitch $MS_5$ arranged to be closed at the last stage is directly connected to the capacitor C to prevent such an accident that the cutter means 5 is not actuated at all, for example, in a case where the rotary switch $SW_1$ initially connected to the contact $P_2$ is changed over to the contact $P_1$ during functioning of the microswitches $MS_1$ and $MS_2$, and thus, it has been made possible to actuate the cutter means 5 without fail upon closing of the microswitch $MS_5$ irrespective of the actuation of the rotary switch $SW_1$ for the size selection. For the above purpose, the contact piece $tc_1$ of the rotary switch $SW_1$ described with reference to FIG. 7 may be further modified so that it is not rotated beyond the contact $P_5$.

It is to be noted that the circuit shown by dotted lines in FIG. 5(*a*) acts as a discharge circuit of the capacitor C for resetting the memorizing state, and is arranged to discharge the electrical charge imparted to the capacitor C through the resistor r upon closing of the switch $SW_2$ to bring the cutter means 5 into a state ready for functioning again. The switch $SW_2$ as described above may be so arranged as to be actuated following completion of the copying operation of the microfilm reader and printer M.

Figure 8:
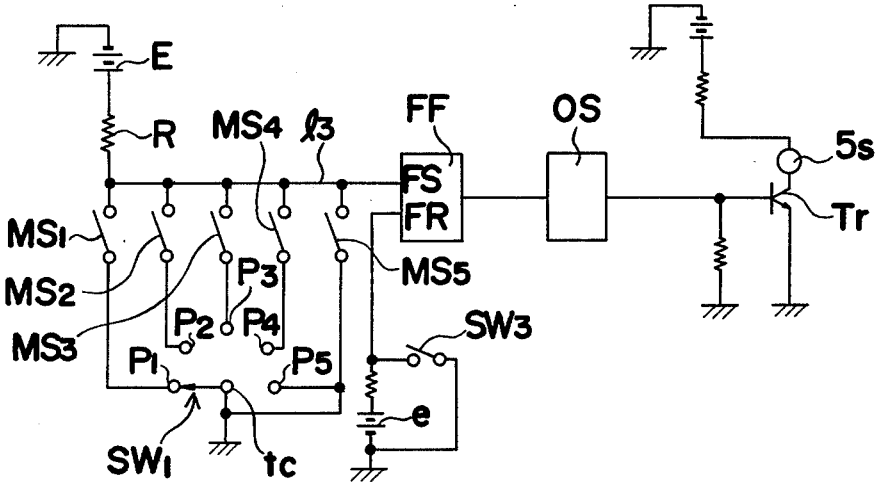
FIG. 8 is a similar diagram to FIG. 5(*a*), but particularly shows a modification thereof.

Referring to FIG. 8, there is shown a modification of the cutter actuation control circuit of FIG. 5(*a*). In this modification, the common terminal tc of the rotary switch $SW_1$ described as connected to the ground line $l_2$ through the capacitor C and relay $RY_1$ in the arrangement of FIG. 5(*a*) is modified to be directly connected to the ground, with the contacts $P_1$ to $P_5$ being respectively connected to the power line $l_3$ through the microswitches $MS_1$ to $MS_5$. The power line $l_3$ connected at its one end to the power source E through the resistor R is coupled at its other end to a set input terminal FS of a flip-flop FF, while a reset input terminal FR of the flip-flop FF is connected through a resistor to another power source e, with a switch $SW_3$ connected in parallel to said power source e as shown. The output terminal of the flip-flop FF is connected to the cutter solenoid 5*s* of the cutter means 5 through a one-shot multivibrator OS and a transistor Tr whose base is connected to the ground through a resistor, with its emitter directly connected to the ground and its collector coupled to the cutter solenoid 5*s*. Therefore, when the microswitches $MS_1$ to $MS_5$ are all open, both the set input and reset input are of "High", while the output is of "Low".

In FIG. 8, on the supposition that the rotary switch $SW_1$ is connected to the contact $P_1$, when the microswitch $MS_1$ is closed following the rotation of the cam group, the input to the set input terminal FS of the flip-flop FF is rendered to be "Low", and by the change of signal, the output from the flip-flop FF becomes "HIGH" for triggering the one-shot multivibrator OS by the rising thereof, and produces therefrom the output pulses of "High" level having a predetermined pulse width, during which pulse period, the cutter means 5 is actuated. The flip-flop FF has the memory function with respect to the set input, and the output thereof maintains the state after being rendered to be "High" due to variation of the set input for one time. Therefore, the one-shot multivibrator OS to be actuated during "Low"-"High" output variation of the flip-flop FF does not produce pulses even when the set input becomes "Low" by the functioning of the other microswitches $MS_2$ to $MS_5$, thus the cutter means 5 being prevented from re-actuation.

It is to be noted here that the reset input of the flip-flop FF is rendered to be "Low" by closing the switch $SW_3$ connected in parallel to the power source e, and the output of the flip-flop FF is returned to "Low". The switch $SW_3$ has a function to release memory of the flip-flop FF which is in the memorizing state in the similar manner as in the switch $SW_2$ mentioned earlier, and may be arranged to be closed at the termination of one cycle of the mechanical equipment, for example, the microfilm reader and printer.

It should also be noted that in the above circuit arrangement of FIG. 8 also, any of the rotary switch constructions as described with reference to FIGS. 6 and 7 may be used, with the microswitch $MS_5$ being directly coupled to the ground potential for the similar reason as in the case of FIG. 5(*a*).

Figure 9:
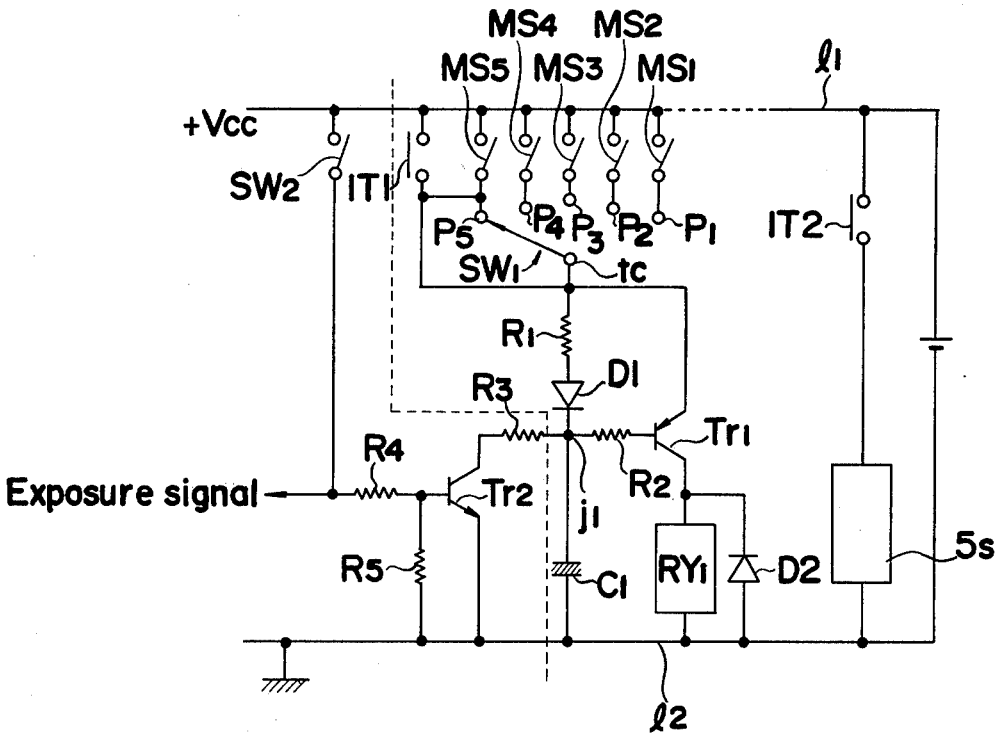
FIG. 9 is also a similar view to FIG. 5(*a*), but particularly shows a further modification thereof.

Referring now to FIG. 9, there is shown another modification of the arrangement of FIG. 5(*a*). In general, the modified circuit of FIG. 9 employing a capacitor $C_1$ is arranged to use the signal of the capacitor $C_1$ to drive the relay through transistors for controlling the cutter solenoid 5*s* at the contacts of the relay as described hereinbelow.

In FIG. 9, the common terminal tc of the rotary switch $SW_1$ is coupled to the stationary contact $P_5$ thereof and to the power line $l_1$ through the normally open contact $1T_1$ of the relay $RY_1$. The terminal tc is also connected to the ground through a resistor $R_1$, a diode $D_1$ for preventing reverse current from the charged capacitor $C_1$ and the capacitor $C_1$, and also to the emitter of a transistor $Tr_1$ whose base is connected through a resistor $R_2$ to a junction $j_1$ between the diode $D_1$ and capacitor $C_1$ and whose collector is coupled to the ground through the relay $RY_1$ and a diode $D_2$ for erasing counter electromotive force from the relay $RY_1$ connected in parallel to each other. The junction $j_1$ is also connected through a resistor $R_3$ to the collector of a transistor $Tr_2$ whose emitter is connected to the ground and whose base is connected to the ground through a stabilizing resistor $R_5$ and also to the power line $l_1$ through a resistor $R_4$ and the switch $SW_2$.

In the above arrangement of FIG. 9, current supplied through the power line $l_1$ is charged into the capacitor $C_1$ through the selected one of the microswitches $MS_1$ to $MS_5$ and the rotary switch $SW_1$ and via the resistor $R_1$ and diode $D_1$. The charging signal of the capacitor $C_1$ is transmitted through the resistor $R_2$ to the base of the PNP transistor $Tr_1$ to the collector of which the relay $RY_1$ is connected as a load. When the power supply is fed to the capacitor $C_1$, current (base current) flows through the resistor $R_2$ from the base of the transistor $Tr_1$ to render the transistor $Tr_1$ conductive and to actuate the relay $RY_1$. Upon completion of the charging of the capacitor $C_1$, the potential at the junction $j_1$ becomes approximately equal to $+Vcc$, with the base current of the transistor $Tr_1$ interrupted, and thus, the transistor $Tr_1$ is rendered non-conductive and the relay $RY_1$ is de-energized, although the cutter solenoid 5*s* is kept turned ON during the above period. Meanwhile, in a discharging circuit at the left of a dotted line in FIG. 9, the switch $SW_2$ is provided for controlling the exposure of the photosensitive paper to the light-wise image when said paper arrives at the exposure station (FIG. 4). The current from the power line $l_1$ is supplied to the base of the transistor $Tr_2$ through the switch $SW_2$ and resistor $R_4$, and thus, when the switch $SW_2$ is turned ON, the transistor $Tr_2$ is rendered conductive to bring the charge of the capacitor $C_1$ to almost zero through the resistor $R_3$.

As is clear from the foregoing description, according to the present invention, in the roll paper cutting arrangement wherein the cutter means is caused to function by a plurality of switching means sequentially actuated through a predetermined relation with the feeding amount of the printing paper drawn from the paper roll at a predetermined transportation speed, with the cut length of the printing paper being made variable through selective use of said switching means, there are provided the memory means to be actuated by the functioning of the selected switching means for maintaining the predetermined memory state and the signal producing means for generating the cutter actuation signal following the functioning of said memory means, and thus, the inconveniences inherent in the conventional arrangements that the cutter means is actuated more than two times in one cycle of operation of the mechanical equipment have been positively eliminated.

Furthermore, according to the arrangement of the present invention, since the particular one of said switching means which is adapted to function finally in the functioning order is arranged to actuate said memory means irrespective of the means for selecting said switching means, the disadvantage in the known arrangements that the cutter means does not function at all during one operating cycle of the mechanical equipment due to wrong operation of the switch selecting means can be positively prevented.

It is to be noted here that, in the foregoing embodiments, although the present invention is mainly described with reference to the microfilm reading and printing apparatus, the concept of the present invention is not limited in its application to such microfilm reading and printing apparatus alone, but may readily be applicable to various other mechanical equipment employing paper in the roll form to be cut into required lengths for use.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. A roll paper cutting arrangement for use in mechanical equipment employing a roll of paper to be cut into predetermined length for use, said roll paper cutting arrangement comprising means for transporting the paper which draws out a leading end of the paper from the roll for transportation, means for cutting the paper to the predetermined length on the passage of transportation of the paper, power source for actuating said cutting means, a first switching means for connecting said power source with said cutting means, a plurality of second switching means, means for sequentially actuating said plurality of second switching means in association with functioning of said transporting means at predetermined relation with respect to feeding amount of the paper, means for selecting one of said plurality of second switching means, and means for memorizing the function of the selected one of said plurality of second switching means, said memorizing means being connected to said second switching means through said selecting means, said first switching means being so arranged as to be actuated following the memorizing function of said memorizing means.

2. A roll paper cutting arrangement as claimed in claim 1, wherein said memorizing means is a capacitor which is charged by functioning of the selected one of said plurality of second switching means, said first switching means being actuated by charging current to said capacitor.

3. A roll paper cutting arrangement as claimed in claim 2, wherein said first switching means is a relay actuated by the charging current to said capacitor, said relay having contacts for closing electrical path to said cutting means during functioning of said relay.

4. A roll paper cutting arrangement as claimed in claim 1, wherein said memorizing means is a flip-flop circuit so arranged as to vary its output state through functioning of said selected one of said plurality of second switching means, said first switching means being actuated following the variation of the output state of said flip-flop circuit.

5. A roll paper cutting arrangement as claimed in claim 4, wherein said first switching means further including a one-shot multivibrator which generates output pulse of predetermined width following the variation of the output from said flip-flop circuit and transistor member actuated by the output pulse of said one-shot multivibrator.

6. A roll paper cutting arrangement as claimed in claim 1, wherein said second switching means are a plurality of microswitches, said means for actuating said second switching means being cam members driven for rotation in association with said transporting means, said plurality of microswitches being arranged around said cam members to be sequentially actuated following rotation of said cam members.

7. A roll paper cutting arrangement as claimed in claim 1, further including means for releasing said memorizing means from its memorized state following functioning of said mechanical equipment.

8. A roll paper cutting arrangement for use in a copying apparatus employing a roll of copy paper to be cut into predetermined length for copying, said roll paper cutting arrangement comprising means for transporting the copy paper which draws out a leading end of the copy paper from the roll for transportation, means for cutting the copy paper to the predetermined length on the passage of transportation of the copy paper, power source for actuating said cutting means, a first switching means for connecting said power source with said cutting means, a plurality of second switching means, means for sequentially actuating said plurality of second switching means in association with functioning of said transporting means at predetermined relation with respect to feeding amount of the copy paper, means for selecting one of said plurality of second switching means, and means for memorizing the function of the selected one of said plurality of second switching means, said memorizing means being connected to said second switching means through said selecting means, said first switching means being so arranged as to be actuated following the memorizing function of said memorizing means.

* * * * *